US010470956B2

(12) United States Patent
Kelch et al.

(10) Patent No.: US 10,470,956 B2
(45) Date of Patent: Nov. 12, 2019

(54) SYSTEM AND METHOD TO PHYSICALLY AND ELECTRONICALLY CONFIGURE AN AIR MATTRESS SYSTEM FOR MULTIPLE USERS

(71) Applicant: HUNTLEIGH TECHNOLOGY LIMITED, Bedfordshire (GB)

(72) Inventors: Randall P. Kelch, San Antonio, TX (US); Michelle Krysztopik, Livingston, TX (US); Shih-Hsun Tu, Taoyuan (TW); Wen-Yen Lee, Bade (TW)

(73) Assignee: Huntleigh Technology Limited (GB)

( * ) Notice: Subject to any disclaimer, the term of this patent is extended or adjusted under 35 U.S.C. 154(b) by 76 days.

(21) Appl. No.: 15/329,235

(22) PCT Filed: Jul. 24, 2015

(86) PCT No.: PCT/US2015/041904
§ 371 (c)(1),
(2) Date: Jan. 25, 2017

(87) PCT Pub. No.: WO2016/014897
PCT Pub. Date: Jan. 28, 2016

(65) Prior Publication Data

US 2017/0209323 A1 Jul. 27, 2017

Related U.S. Application Data

(60) Provisional application No. 62/029,175, filed on Jul. 25, 2014.

(51) Int. Cl.
*A61G 7/00* (2006.01)
*A61G 7/057* (2006.01)
(Continued)

(52) U.S. Cl.
CPC ..... *A61G 7/05769* (2013.01); *A61G 7/0015* (2013.01); *A61G 7/018* (2013.01);
(Continued)

(58) Field of Classification Search
CPC ..... A61G 7/00
(Continued)

(56) References Cited

U.S. PATENT DOCUMENTS 5,586,346 A 12/1996 Stacy et al.
5,594,963 A 1/1997 Berkowitz
(Continued)

FOREIGN PATENT DOCUMENTS

JP 2002351596 A 12/2002
JP 2012205722 A 10/2012

OTHER PUBLICATIONS

Written Opinion of International Application No. PCT/US15/41904, dated Oct. 20, 2015.

*Primary Examiner* — Fredrick C Conley
(74) *Attorney, Agent, or Firm* — The Webb Law Firm

(57) ABSTRACT

A patient support apparatus includes an inflatable mattress for supporting a patient and an air supply for supplying air to the inflatable mattress. A control system controls the air supply and inflatable mattress to provide therapeutic functions. The control system is configurable to make a subset of the therapeutic functions available to a user. A control panel containing controls for therapeutic functions is provided. An interchangeable bezel covers the control panel to provide access to controls for the subset of available therapeutic functions.

20 Claims, 7 Drawing Sheets

(51) Int. Cl.
*A61G 7/018* (2006.01)
*A61G 7/05* (2006.01)

(52) U.S. Cl.
CPC ..... *A61G 7/0506* (2013.01); *A61G 7/05792* (2016.11); *A61G 2203/16* (2013.01)

(58) Field of Classification Search
USPC ..... 5/706, 600
See application file for complete search history.

(56) References Cited

U.S. PATENT DOCUMENTS

| | | | | |
|---|---|---|---|---|
| 5,611,096 | A | 3/1997 | Bartlett et al. | |
| 5,630,238 | A | 5/1997 | Weismiller et al. | |
| 6,111,207 | A | 8/2000 | Arterberry et al. | |
| 7,990,288 | B2 | 8/2011 | Marchetto | |
| 2005/0229321 | A1 | 10/2005 | Phillips et al. | |
| 2011/0035079 | A1* | 2/2011 | Allen | G05D 1/0016 701/2 |
| 2011/0071368 | A1* | 3/2011 | Baker, Jr. | A61B 5/14551 600/301 |
| 2011/0072583 | A1* | 3/2011 | McNeely | A61G 12/00 5/616 |
| 2014/0059770 | A1 | 3/2014 | Williamson et al. | |

* cited by examiner

SYSTEM AND METHOD TO PHYSICALLY AND ELECTRONICALLY CONFIGURE AN AIR MATTRESS SYSTEM FOR MULTIPLE USERS

CROSS-REFERENCE TO RELATED APPLICATIONS

This application is a nationalization, pursuant to 37 C.F.R. 371, of international patent application no. PCT/US2015/041904, filed on Jul. 24, 2015, which in turn claims benefit of priority to US provisional application no. 62/029,175, filed on Jul. 25, 2014, all the foregoing applications of which are incorporated by reference in their entirety herein.

FIELD OF THE DISCLOSURE

This application relates generally to therapeutic mattress systems and, more particularly, to methods and systems for controlling therapeutic mattress systems.

DESCRIPTION OF RELATED ART (BACKGROUND OF THE DISCLOSURE)

Active therapeutic mattress systems are used for the care, support and comfort of patients. Typically, such mattresses include an air supply that selectively inflates inflatable bladders to provide various therapeutic treatments, such as turning, tilting, low air loss therapy, pulsation therapy, percussion therapy, and other dynamic therapies.

Active therapeutic mattress systems are often only needed for short term usage and hospitals often rent such systems from specialized providers. These rental providers may maintain a fleet of numerous types of systems to provide different therapies for different patients. However, maintaining an inventory of highly specialized diverse products is costly and inefficient. Therefore, there is a need for more efficient active therapeutic mattress systems.

SUMMARY OF THE DISCLOSURE

In some embodiments, a patient support apparatus comprises an inflatable mattress for supporting a patient and an air supply coupled to the inflatable mattress. The air supply provides a plurality of therapeutic functions and is configurable to make a subset of the plurality of therapeutic functions available to a user. A control panel for operating the air supply contains controls for each of the plurality of therapeutic functions. An interchangeable bezel covers the control panel to provide access to controls for the subset of available therapeutic functions and obscure controls for unavailable therapeutic functions.

The air supply may be operable in one or more modes, each mode correlating to a subset of the plurality of therapeutic functions.

The control panel may comprise a dedicated switch for selecting the mode of operation of the control system. The dedicated switch may comprise a jumper switch.

The mode of operation may be selected through operation of the control panel. The control panel may comprise a membrane switch panel.

In some embodiments, a control system for a patient support apparatus having an inflatable mattress powered by an air supply comprises a control panel for controlling the operation of the air supply to provide therapeutic functions. The control panel has switches for controlling therapeutic functions, and an interchangeable bezel for covering the control panel. The bezel obscures switches for operating therapeutic functions that are not available.

The air supply may be configurable to operate in a plurality of modes, each mode providing a subset of the plurality of therapeutic functions.

The control panel may comprise a dedicated switch for selecting the mode of operation of the air supply. The dedicated switch may comprise a jumper switch.

The mode of operation may be selected through operation of the control panel. The mode of operation may be automatically selected by software and/or hardware.

In some embodiments, a method of operating a patient support apparatus comprises providing a control panel for operating a patient support device to provide a plurality of therapeutic functions, selecting a set of the plurality of therapeutic functions to make available, and covering the control panel with a bezel corresponding to the selected set of the plurality of therapeutic functions. The selecting step may comprise operating the control panel to select a mode of operation.

The term "coupled," in accordance with this disclosure, is defined as connected, although not necessarily directly. The terms "a" and "an" are defined as one or more unless this disclosure explicitly requires otherwise.

The terms "substantially," "approximately," and "about" are defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, or a component of a system, that "comprises," "has," "includes" or "contains" one or more elements or features possesses those one or more elements or features, but is not limited to possessing only those elements or features. Likewise, a method that "comprises," "has," "includes" or "contains" one or more steps possesses those one or more steps, but is not limited to possessing only those one or more steps. Additionally, terms such as "first" and "second" are used only to differentiate structures or features, and not to limit the different structures or features to a particular order.

A device, system, or component of either that is configured in a certain way is configured in at least that way, but it can also be configured in other ways than those specifically described.

Any embodiment of any of the systems and methods can consist of or consist essentially of—rather than comprise/include/contain/have—any of the described elements, features, and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are presented below.

DETAILED DESCRIPTION OF THE DISCLOSURE

Figure 1:
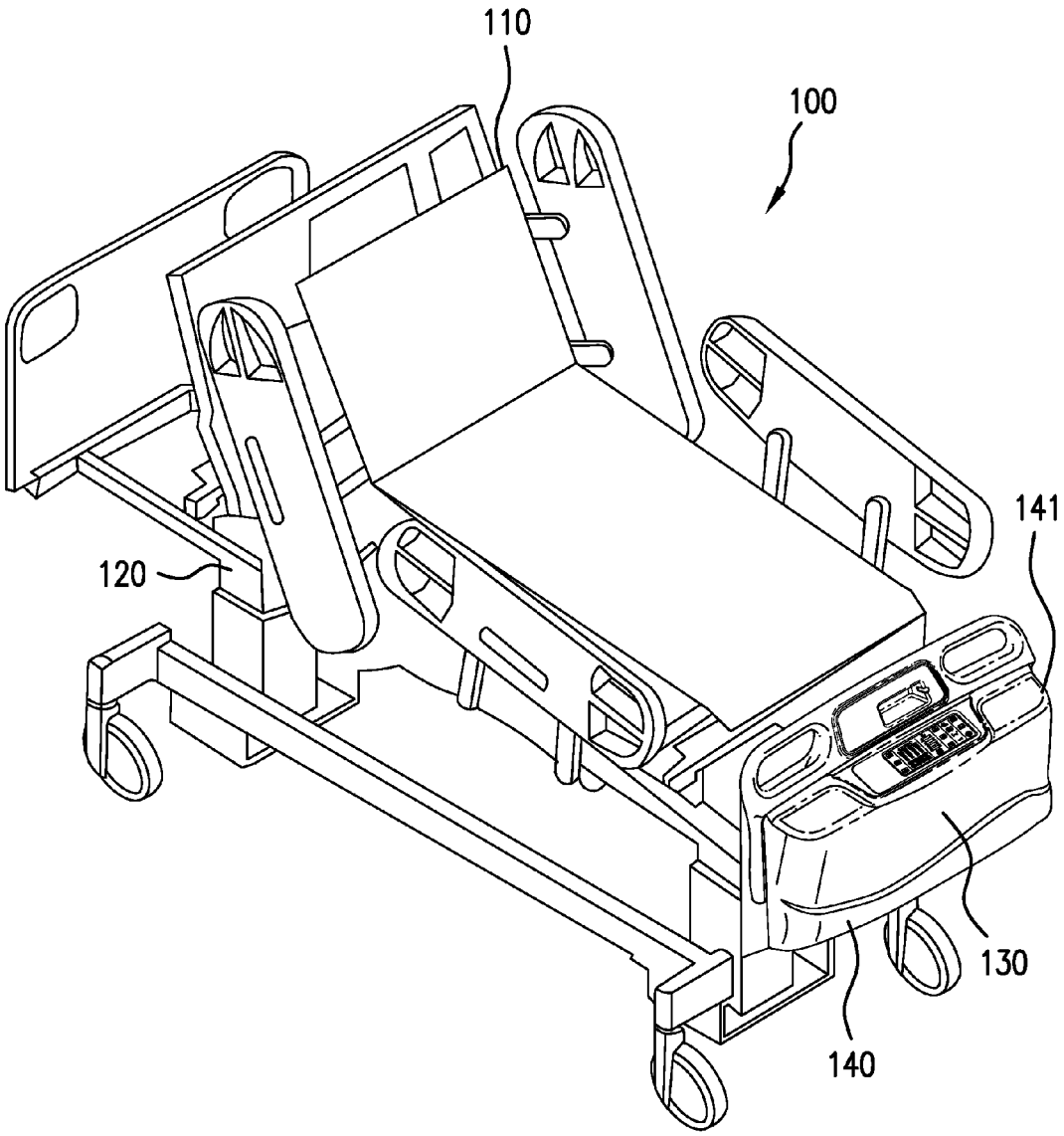
FIG. 1 is a perspective view of an embodiment of a patient support system with an air supply system.
Figure 2:
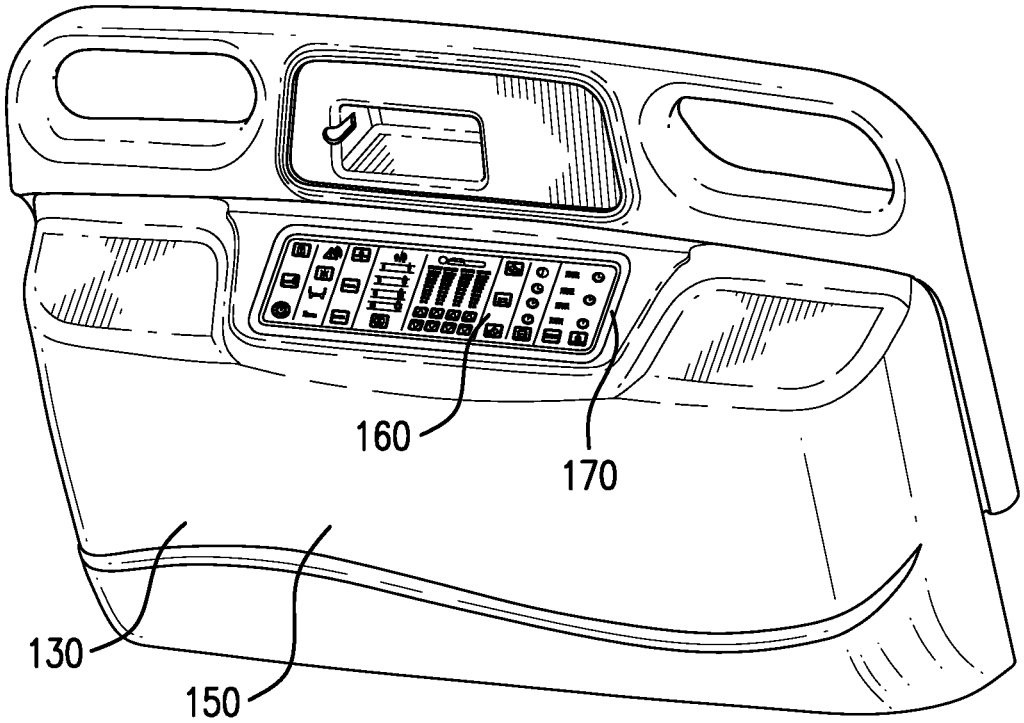
FIG. 2 is a perspective view of an embodiment of an air supply system adjacent to the foot end of a patient support system with a bezel providing full functionality.
Figure 3:
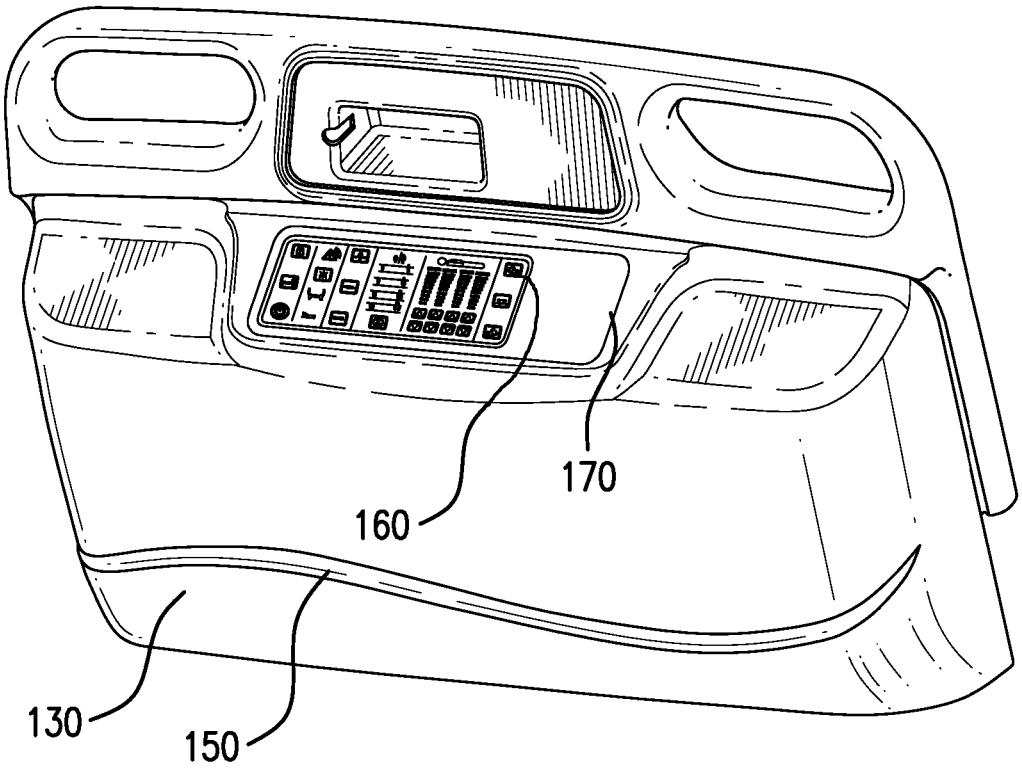
FIG. 3 is a perspective view of an embodiment of an air supply system adjacent to the foot end of a patient support system with a bezel providing lower functionality than the bezel shown in FIG. 2.
Figure 4:
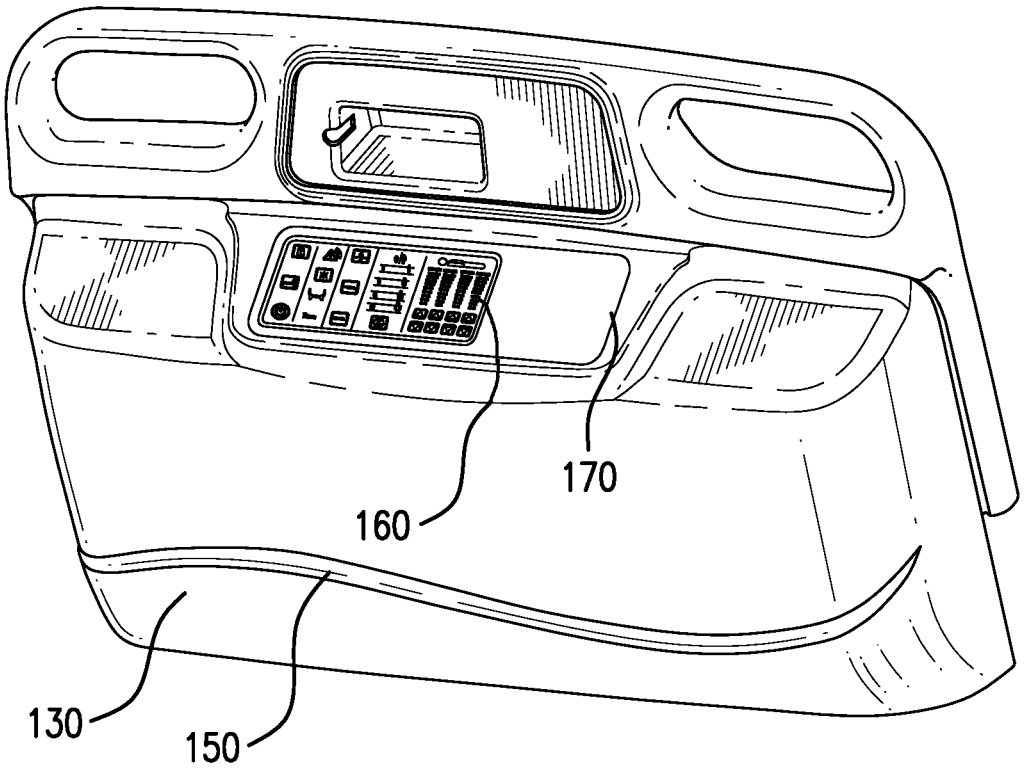
FIG. 4 is a perspective view of an embodiment of an air supply system adjacent to the foot end of a patient support system with a bezel providing lower functionality than the bezels shown in FIGS. 2 and 3.

In the following detailed description, reference is made to the accompanying drawings, in which are shown exemplary but non-limiting and non-exhaustive embodiments. These embodiments are described in sufficient detail to enable those having skill in the art to practice them the corresponding principles of this disclosure, and it is understood that other embodiments may be used, and other changes may be made, without departing from the spirit or scope of this disclosure. The following detailed description is, therefore, not to be taken in a limiting sense, and the scope of one or more inventions is defined only by the appended claims. In the accompanying drawings, like reference numerals refer to like parts throughout the various figures unless otherwise specified.

Referring to the embodiments shown in FIGS. 1-7, a patient support system 100 comprises an inflatable mattress 110, a frame 120, an air supply system 130, and a docking station 140 configured to releasably couple to air supply system 130. A docking station to connect the mattress 110 to the air supply system 130 may also be provided. The air supply system 130 is configured to provide air to the inflatable mattress 110. Further details regarding a suitable air supply system are disclosed in published patent application number 2011/0131725, entitled "Patient support system with modular integrated fluid supply system," which is hereby incorporated by reference in its entirety.

The air supply system 130 comprises a housing 150 with a control panel 160. The control panel 160 is coupled to a controller, which allows a user to control the air supply system 130 to provide various therapeutic functions to a patient positioned on the inflatable mattress. Such therapeutic functions may include positioning, turning, tilting, low air loss therapy, pulsation therapy, percussion therapy, and other dynamic therapies. The controller may also provide other common features, such as patient positioning functions to provide adjustments for patient comfort, seat deflation, mattress firmness, transport mode, and the like. As used herein, the term "therapeutic functions" includes any functionality provided by the controller. The controller may be integral with the control panel 160 (e.g., on the same printed circuit board) to minimize size and costs.

In some embodiments, the air supply system 130 only contains the components necessary to provide a certain level of functionality. For example, if only basic functionality such as turning and positioning is desired, only the components associated with those functions are included. Components associated with other, more advanced therapies, such as percussion therapy, are omitted. In some embodiments, components for all available therapies are installed, although access to their functionality may be selectively controlled, as will be discussed in detail below.

The control panel 160 comprises a plurality of user operable switches for operating the various functions provided by the air supply system 130. The user operable switches may be membrane switches. The control panel 160 has an interchangeable bezel 170. The interchangeable bezels 170 are coupled to the control panel by removable fasteners. In one embodiment, the bezel 170 has multiple ribbed posts which are inserted into holes in the housing 150 and/or control panel 160. This allows for easy installation, removal, and multiple uses of the same part.

Figure 5:
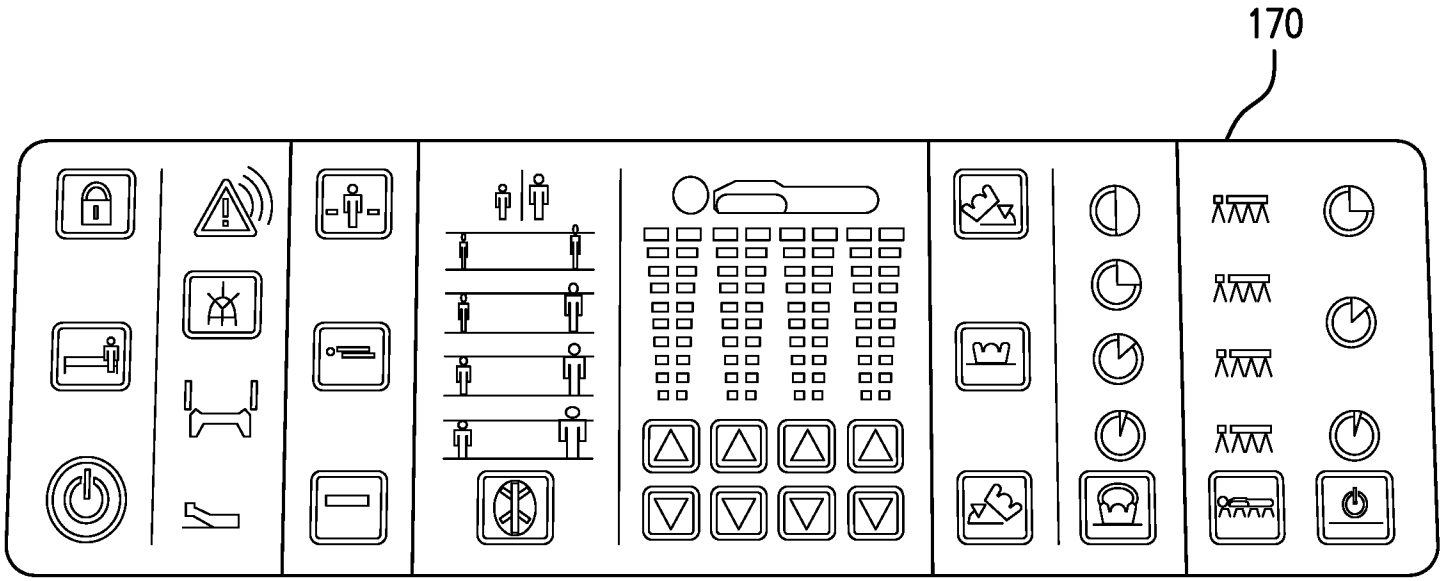
FIG. 5 is a front view of a bezel providing full functionality.
Figure 6:
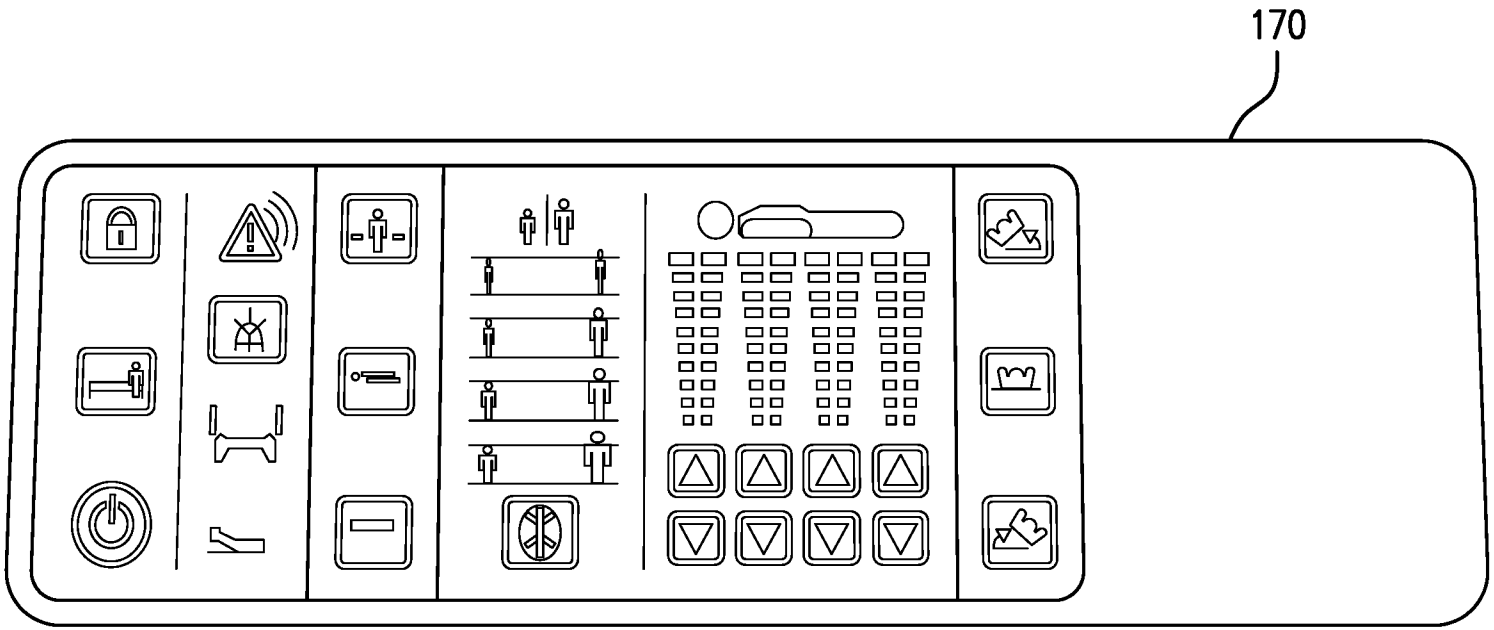
FIG. 6 is a front view of a bezel providing lower functionality than the bezel shown in FIG. 5.
Figure 7:
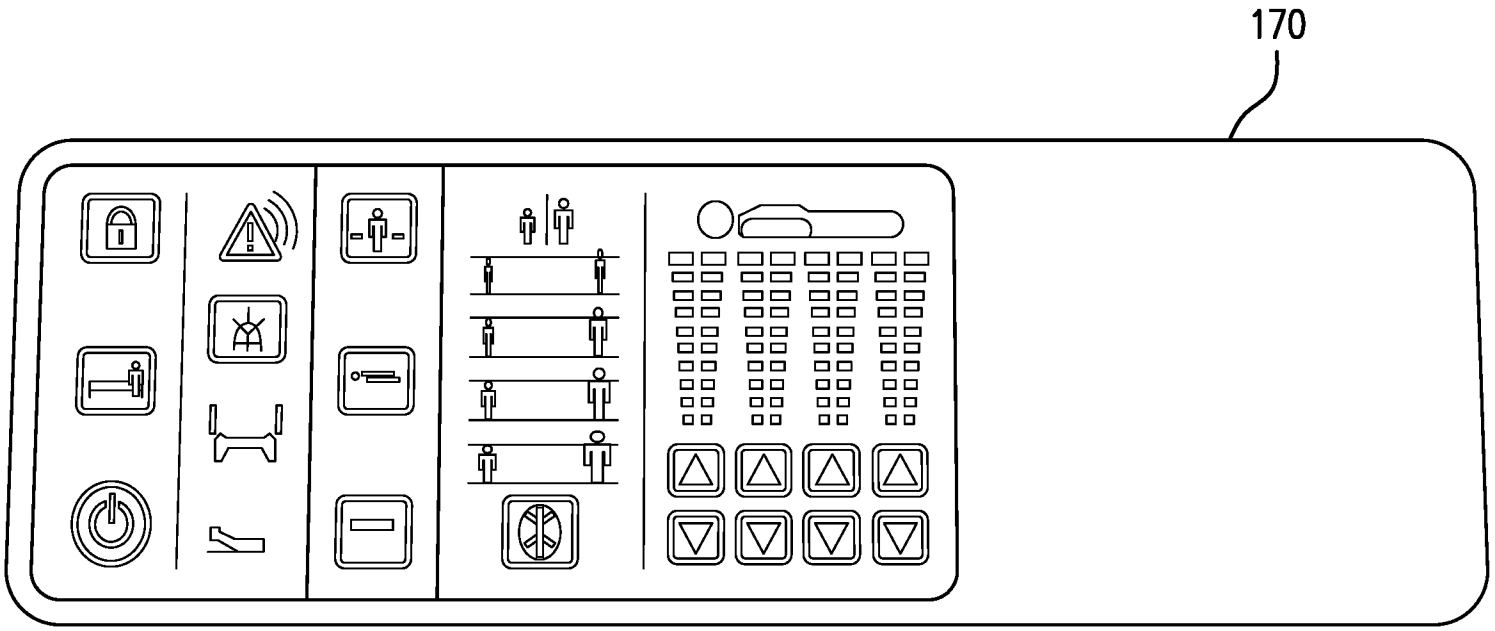
FIG. 7 is a front view of a bezel providing lower functionality than the bezels shown in FIGS. 5 and 6.

A plurality of interchangeable bezels 170 is provided. For example, FIGS. 5, 6, and 7 show a full functionality bezel, a medium functionality bezel, and a low functionality bezel, respectively. Indicia on the bezels indicate which functions are available and block access to the switches for functions that are not available.

In some embodiments, the control panel 160 is the same regardless of which functions are provided by the air supply 130. For example, the air supply may only provide positioning and turning functions, and therefore, many of the switches on the control panel would be unnecessary (for example, switches for percussion therapy). In this case, the control panel 160 is covered by a bezel 170 that only shows the available functions (e.g., the bezel shown in FIG. 7). A switch may be included on the control panel 160 to determine which functions are available. The switch may be set at manufacturing, and may be a jumper switch or any other suitable switch. The use of a single control panel regardless of which functions are available eases inventory management for manufacturing and for service and repair centers, who may maintain a single part for multiple air supplies. In some embodiments, the software and/or hardware of the air supply controller sends information to the control panel 160 regarding the available functionality (e.g., installed components) and the control panel adjusts the accessible functions accordingly.

In some embodiments, the air supply 130 may contain the components necessary to provide all therapeutic functions, but may have multiple modes of operation which limit availability of certain functions. For example, the air supply 130 may have a first "A" mode providing limited functionality (i.e., lowest functionality), a second "B" mode providing more functionality (i.e., intermediate functionality), and a third "C" mode providing full functionality. The modes may be preset at manufacturing or may be updated and revised after manufacturing (i.e., highest functionality). The mode may be selected by a mechanical switch. Alternatively, the mode may be selected by a key sequence on the keypad. For example, a specific combination of keys and/or key presses may place the controller in one mode of operation, while a different combination of keys and key presses places the controller in a different mode of operation. The interchangeable bezel 170 is matched with the appropriate functionality. In other words, in accordance with an embodiment, a plurality of interchangeable bezels 170 are provided, wherein each one of the bezels 170 corresponds to a different level of functionality so that the appropriate bezel 170 may be coupled to the housing 150 so as to match the currently selected functionality. For example, in accordance with an embodiment, the plurality of interchangeable bezels 170 include a lowest functionality bezel (FIG. 7), an intermediate functionality bezel (FIG. 6) and a highest functionality bezel (FIG. 5), which are interchangeably coupled to the housing 150 so that the lowest functionality bezel may be coupled to the housing 150 when the air supply 130 is configured to operate in the lowest functionality mode, and so that the intermediate functionality bezel may be coupled to the housing 150 when the air supply 130 is configured to operate in the intermediate functionality mode, and so that the highest functionality bezel may be coupled to the housing 150 when the air supply 130 is configured to operate in the highest functionality mode.

Providing multiple modes of operation would be beneficial for a rental fleet. A rental customer may only wish to obtain a limited functionality air support system (which costs less), but a rental provider may only have units available with higher functionality or multiple functionalities. The rental provider can service the customer with a unit limited to a lower level of functionality, while preventing the customer from accessing more complicated (and more expensive) therapies. Alternatively, a rental provider may choose to only purchase air supply units with complete functionality and select the mode of operation based on customer needs, which would ease rental fleet management.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be combined as a unitary structure, and/or connections may be substituted (e.g., threads may be substituted with press-fittings or welds). Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A patient support apparatus comprising:

an inflatable mattress for supporting a patient;

an air supply coupled to the inflatable mattress, wherein the air supply provides a plurality of therapeutic functions, and the air supply is configurable to enable a subset of the plurality of therapeutic functions as available functionalities to a user;

a control panel disposed to operate the air supply, wherein the control panel includes controls for each of the plurality of therapeutic functions; and an interchangeable bezel configured to cover the control panel, wherein the bezel provides access to controls for the subset of available therapeutic functions and obscures controls for unavailable therapeutic functions.

2. The patient support apparatus of claim 1, wherein the air supply is operable in a plurality of modes, wherein each mode correlates to one subset of the plurality of therapeutic functions.

3. The patient support apparatus of claim 2, wherein the control panel further comprises a dedicated switch operable to select the mode of operation of the control system.

4. The patient support apparatus of claim 3, wherein the dedicated switch comprises a jumper switch.

5. The patient support apparatus of claim 1, wherein the mode of operation is selected through operation of the control panel.

6. The patient support apparatus of claim 1, wherein the control panel comprises a membrane switch panel.

7. The patient support apparatus of claim 1, wherein the control panel further comprises a dedicated switch operable to select the mode of operation of the control system.

8. A method of operating a patient support apparatus comprising a control panel for operating the patient support device to provide a plurality of therapeutic functions, wherein the method includes the steps of:

selectively enabling a set of the plurality of therapeutic functions to make the selected set of therapeutic functions available via the control panel; and covering the control panel with a bezel corresponding to the selected set of the plurality of therapeutic functions.

9. The method of claim 8, wherein the selective enablement of the set of the plurality of therapeutic functions comprises operating the control panel to select a mode of operation.

10. A control system for a patient support apparatus having an inflatable mattress powered by an air supply, comprising:

a control panel operable to control operation of the air supply to provide therapeutic functions, wherein the control panel has switches for controlling the therapeutic functions; and an interchangeable bezel for covering the control panel, wherein the bezel obscures switches for operating therapeutic functions that are not available.

11. A patient support apparatus comprising:

an inflatable mattress for supporting a patient;

an air supply coupled to the inflatable mattress, wherein the air supply provides a plurality of therapeutic functions, and the air supply is configurable to enable a subset of the plurality of therapeutic functions as available functionalities to a user;

a control panel disposed to operate the air supply, wherein the control panel includes controls for each of the plurality of therapeutic functions and the air supply is configurable to operate in a plurality of modes, wherein a mode of operation of the air supply is selected through operation of the control panel and each mode provides a subset of the plurality of therapeutic functions; and a set of interchangeable bezels, wherein each bezel is configured to cover the control panel and corresponds to one of the plurality of modes, and each bezel provides access to controls for the subset of enabled therapeutic functions of the corresponding mode and obscures controls for disabled therapeutic functions of the corresponding mode.

12. The control system of claim 10, wherein the air supply is configurable to operate in a plurality of modes, wherein each mode provides a subset of the plurality of therapeutic functions.

13. The patient support apparatus of claim 12, wherein the control panel further comprises a dedicated switch operable to select the mode of operation of the air supply.

14. The patient support apparatus of claim 13, wherein the dedicated switch comprises a jumper switch.

15. The patient support apparatus of claim 12, wherein the mode of operation is automatically detected by operation of software, or hardware, or of both the software and the hardware.

16. The patient support apparatus of claim 12, wherein the mode of operation is selected through operation of the control panel.

17. The patient support apparatus of claim 10, wherein the control panel further comprises a dedicated switch operable to select the mode of operation of the air supply.

18. The patient support apparatus of claim 10, wherein the mode of operation is automatically detected by operation of software, or hardware, or of both the software and the hardware.

19. The patient support apparatus of claim 10, wherein the mode of operation is selected through operation of the control panel.

20. The patient support apparatus of claim 11, wherein the plurality of modes include a low functionality mode, an intermediate functionality mode and a high functionality mode, wherein the high functionality mode has more enabled therapeutic functions than the intermediate functionality mode and the intermediate functionality mode has more enabled therapeutic functions than the low functionality mode, and wherein the low functionality mode has more disabled therapeutic functions than the intermediate functionality mode and the intermediate functionality mode has more disabled therapeutic functions than the high functionality mode, and the set of interchangeable bezels include a lowest functionality bezel, an intermediate functionality bezel and a high functionality bezel, wherein the low functionality bezel covers the control panel when the low functionality mode has been selected, and the intermediate functionality bezel covers the control panel when the intermediate functionality mode has been selected, and the high functionality bezel covers the control panel when the high functionality mode has been selected.

* * * * *